US010345840B1

(12) United States Patent
Cao

(10) Patent No.: US 10,345,840 B1
(45) Date of Patent: Jul. 9, 2019

(54) LOW DROPOUT REGULATOR (LDO)

(71) Applicant: Hua Cao, Leander, TX (US)

(72) Inventor: Hua Cao, Leander, TX (US)

( * ) Notice: Subject to any disclaimer, the term of this patent is extended or adjusted under 35 U.S.C. 154(b) by 0 days.

(21) Appl. No.: 16/245,568

(22) Filed: Jan. 11, 2019

Related U.S. Application Data

(60) Provisional application No. 62/627,585, filed on Feb. 7, 2018.

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC . G05F 1/56; G05F 1/563; G05F 1/565; G05F 1/569; G05F 1/575; G05F 1/59; G05F 1/595
See application file for complete search history.

(56) References Cited

U.S. PATENT DOCUMENTS 7,446,515 B2 * 11/2008 Wang ..... G05F 1/575 323/275
7,570,035 B2 * 8/2009 Kleveland ..... G05F 1/575 323/273
9,069,370 B2 * 6/2015 Soenen ..... G05F 1/575
2016/0349777 A1 * 12/2016 Caracciolo ..... G05F 1/575
2017/0052553 A1 * 2/2017 Gebeyehu ..... G05F 1/575
2017/0242449 A1 * 8/2017 Chen ..... G05F 1/575

FOREIGN PATENT DOCUMENTS

EP 2857923 A1 * 4/2015 ..... G05F 1/46

* cited by examiner

*Primary Examiner* — Matthew V Nguyen

(57) ABSTRACT

A novel low dropout regulator (LDO) is presented. The LDO includes the generation of a first feedback signal and a second feedback signal. The first feedback signal and a reference signal connect to a first error amplifier. The second feedback signal and the first error amplifier output signal connect to a second error amplifier. The output signal from the second error amplifier is coupled to the gate of a FET transistor. The FET transistor can be either a p-channel FET transistor, an n-channel FET transistor, a NMOS pass transistor, or a PMOS pass transistor. The positive input terminal or the negative input terminal of the first amplifier or of the second amplifier therefore need to be configured accordingly. When the source of the FET transistor is connected to the input voltage VIN, the drain of the FET transistor is the output voltage VOUT; when the drain of the FET transistor is connected to the input voltage VIN, the source of the FET transistor is the VOUT.

14 Claims, 8 Drawing Sheets

LOW DROPOUT REGULATOR (LDO)

CROSS-REFERENCE TO RELATED APPLICATIONS

Prior Application Status: Pending
Continuity Type: Claims benefit of provisional
Prior Application Number: U.S. 62/627,585
Filing date: 2018 Feb. 2007 (YYYY-MM-DD)

BACKGROUND OF THE INVENTION

The subject invention relates to a voltage regulator receiving an input voltage and generating a regulated output voltage; the subject invention also relates to a low dropout voltage regulator or an LDO where the input source of voltage is substantially fixed and the regulator output voltage is maintained at a substantially constant level.

Low dropout voltage regulators or LDOs, sometimes referred to as DC linear voltage regulators, are used to convert an input supply voltage from the input voltage VIN to a desired output voltage VOUT on an output node. The output voltage can be maintained to have a substantially constant magnitude.

Feedback control circuits are used to regulate and control the power. In some applications, the output voltage can be adjusted externally to a desirable level through at least one resistor coupled to the feedback signal which is generated from the regulator output voltage.

In modern low dropout voltage regulator or LDO design, one of the challenging tasks is to support high load current over a wide range of operating conditions. In order to improve an LDO voltage regulator, various techniques have been used in the prior arts.

BRIEF SUMMARY OF THE INVENTION

It is therefore an objective of the subject invention to disclose a low dropout voltage regulator (LDO) that can support high load current applications with a minimum of additional circuitry.

In an embodiment of the subject invention, a first feedback signal and a second feedback signal are generated. A first amplifier receives a reference signal and the first feedback signal and generate the first amplifier output signal. A second amplifier receives the second feedback signal and the first amplifier output signal. The second amplifier output signal is connected to a gate of a p-channel FET transistor. In another alternative embodiment, the p-channel FET transistor can be replaced with an n-channel FET transistor, where the positive terminal and the negative terminal of the first amplifier or of the second amplifier may be re-configured accordingly.

In an alternative embodiment of a low dropout voltage regulator, according to the subject invention, a p-channel FET transistor and an n-channel FET transistor are connected in series between the input voltage VIN and the ground potential. The drain of the p-channel FET transistor and the drain of the n-channel FET transistor are connected to a gate of a transistor. The transistor is connected between the VIN and the VOUT. In some applications, the p-channel FET transistor and the n-channel FET transistor can belong to the second error amplifier. The transistor may be configured to be a Field Effect Transistor (FET), such as JFET and MOSFET or a Bipolar Junction Transistor (BJT) transistor.

The feedback signals can be generated in various feedback generation circuits. The feedback generation circuit shown in FIG. 1-FIG. 8 is only one of them and it can have many alternatives.

The foregoing and a better understanding of the present subject invention will become apparent from the following detailed description of exemplary embodiments and the claims when read in connection with the accompanying drawings, all forming a part of the disclosure of this subject invention. As will be realized, the subject invention is capable of other and different alternative embodiments. Its several details are capable of modifications in various obvious respects, all without departing from the present subject invention. Accordingly, the drawings and description are to be regarded as illustrative in nature, and not as restrictive.

BRIEF DESCRIPTION OF DRAWINGS

It is understood that other embodiments of the subject invention will become readily apparent to those skilled in the art from the following detailed description, wherein it is shown and described only various embodiments of the invention by way of illustration. In the drawings, like reference numbers generally indicate identical, functionally similar, and/or structurally similar elements. While the foregoing and following written and illustrated disclosure focuses on disclosing exemplary embodiments of the subject invention, it should be understood that the same is by way of illustration and example only and the invention is not limited thereto. The following represents brief descriptions of the drawings, wherein.

DETAILED DESCRIPTION OF THE INVENTION

It is understood that other embodiments of the present subject invention will become readily apparent to those skilled in the art from the following detailed description of example embodiments and the claims, wherein it is shown and described only various embodiments of the invention by way of illustration. The invention can be implemented in numerous ways, including as a process, an apparatus, a system, or a composition of matter. In this specification, these implementations, or any other form that the invention may take, may be referred to as techniques. In general, the order of the steps of disclosed processes may be altered within the scope of the subject invention.

The detailed description set forth below in connection with the appended drawings is intended as a description of exemplary embodiments of the subject invention and is not intended to represent the only embodiments in which the subject invention can be practiced. The term "exemplary" means "serving as an example, instance, or illustration," and should not necessarily be construed as preferred or advantageous over other alternative embodiments. The detailed description includes specific details for the purpose of providing a thorough understanding of the subject invention. However, it will be apparent to those skilled in the art that the subject invention may be practiced without these specific details. In some instances, well-known structures and devices are shown in block diagram form in order to avoid obscuring the concepts of the subject invention. These structures and devices, as well as other blocks, modules, and circuits may be "coupled" or "connected" together to perform various functions. The term "coupled" or "connected" mean either a direct connection, or where appropriate, an indirect connection.

Figure 1:
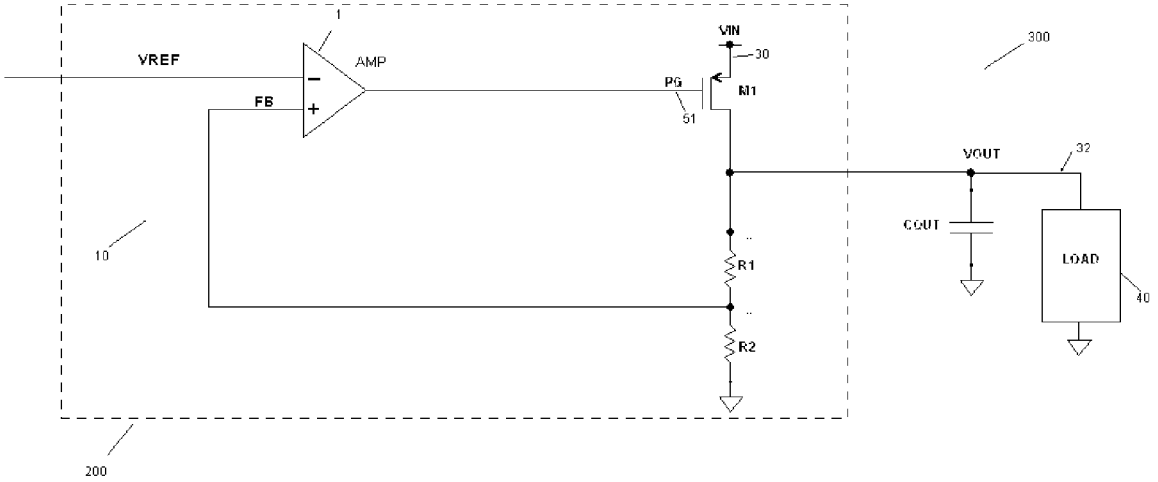
Figure 1 (Prior Art)
FIG. 1 is a schematic diagram of a first prior art LDO voltage regulator.

FIG. 1 is a schematic diagram illustrating a first prior art of a low dropout voltage regulator 300. Referring to FIG. 1, a low dropout voltage regulator 300 includes a p-channel FET transistor M1, a feedback network comprising a resistor R1 and a resistor R2 as a voltage divider, and an error amplifier AMP. The AMP receives the reference signal at its negative terminal and receives the feedback signal FB at its positive terminal. The output signal of the error amplifier is connected to the gate of the p-channel FET transistor. The source of M1 is connected to the input voltage VIN. The drain of M1 is the LDO output voltage VOUT.

Figure 2:
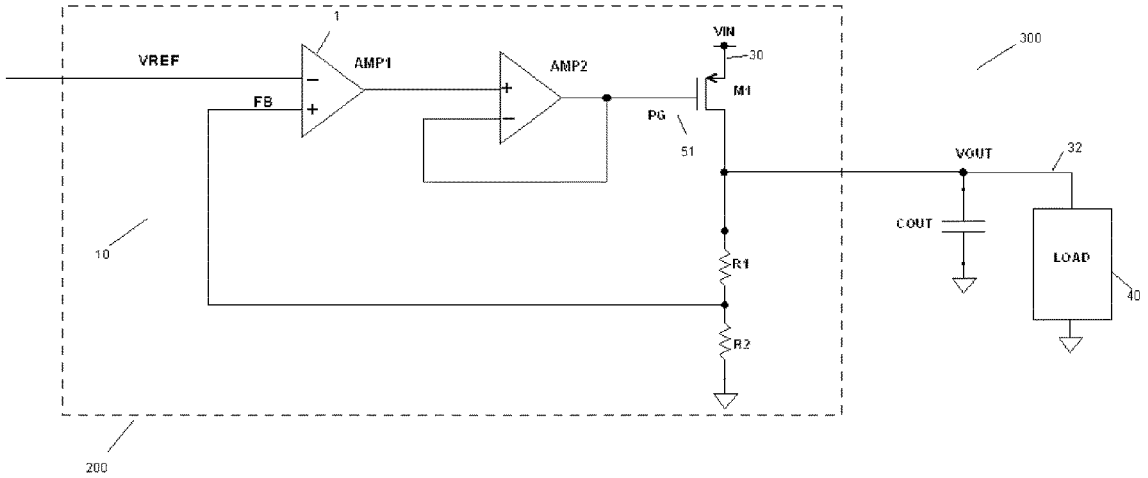
Figure 2 (Prior Art)
FIG. 2 is a schematic diagram according to a second prior art LDO voltage regulator.

FIG. 2 is a schematic diagram illustrating another prior art of a low dropout regulator 300. Referring to FIG. 2, a low dropout regulator 300 includes a p-channel FET transistor, a feedback network comprising a resistor R1 and a resistor R2 as a voltage divider, a first amplifier AMP1, and a second amplifier AMP2. The AMP1 receives the reference signal at its negative terminal and receives the feedback signal FB at its positive terminal. The output signal of AMP1 is connected to the positive terminal of AMP2. The negative terminal of AMP2 is connected to the output of AMP2. The output of AMP2 is connected to the gate of the p-channel FET transistor. The source of M1 is connected to the input voltage VIN. The drain of M1 is the LDO output voltage VOUT.

Figure 3:
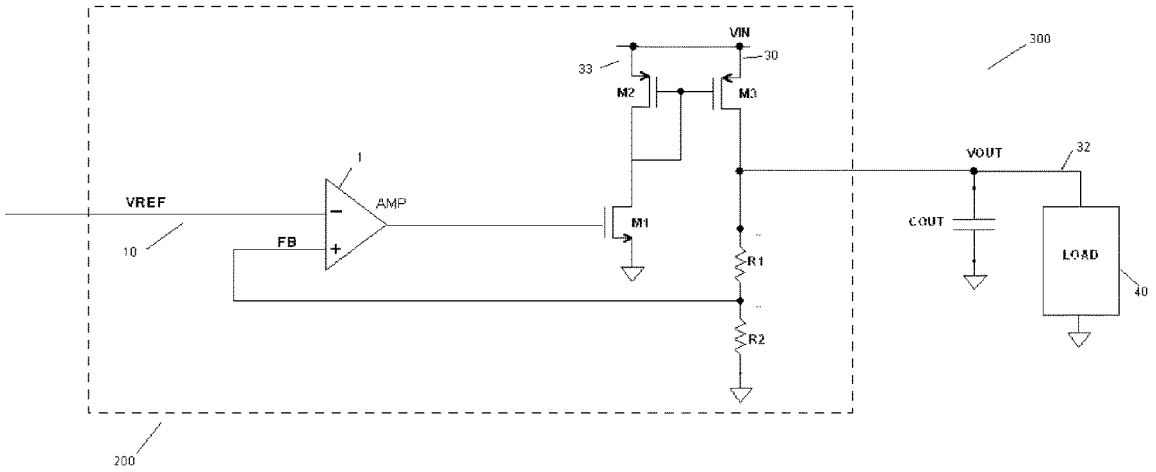
Figure 3 (Prior Art)
FIG. 3 is a diagram illustrating a third prior art LDO regulator.

FIG. 3 is a schematic diagram illustrating another prior art of a low dropout regulator 300. Referring to FIG. 3, a low dropout voltage regulator 300 includes an n-channel FET transistor M1, a first p-channel FET transistor M2, a second p-channel FET transistor M3, a feedback network comprising a resistor R1 and a resistor R2 as a voltage divider, and an error amplifier AMP. The AMP receives the reference signal at its negative terminal and receives the feedback signal FB at its positive terminal. The output signal of the error amplifier is connected to the gate of M1. The source of M2 and the source of M3 are connected to the input voltage VIN. The drain of M3 is the LDO output voltage VOUT. M1 and M2 are connected in series between VIN and the ground potential. The gate of M2 is connected to the gate of M3. The gate of M2 and the gate of M3 are connected to the drain of the M2 and the drain of the M3.

Figure 4:
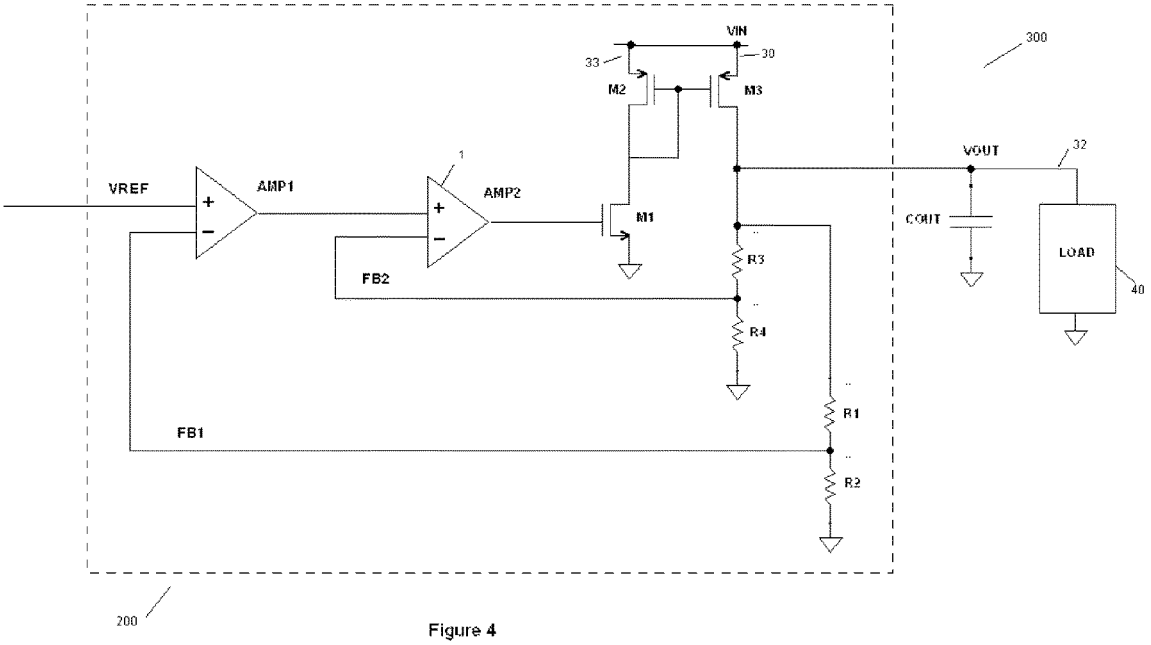
FIG. 4 is a schematic diagram of a low dropout voltage regulator (LDO) according to an embodiment of the subject invention where a first p-channel FET transistor, a second p-channel FET transistor and an n-channel FET transistor are used.

FIG. 4 is a schematic diagram of a low dropout voltage regulator (LDO) 300 according to an embodiment of the subject invention. Regulator 300 receives an input voltage VIN and generates a regulated output voltage VOUT. Referring to FIG. 4, a low dropout voltage regulator 300 includes an n-channel FET transistor M1, a first p-channel FET transistor M2, a second p-channel FET transistor M3, a first feedback network comprising a resistor R1 and a resistor R2 as a voltage divider, a second feedback network comprising a resistor R3 and a resistor R4, a first error amplifier AMP1, and a second error amplifier AMP2; wherein a source of said first p-channel FET transistor connected to said input voltage VIN; wherein a drain of said second p-channel FET transistor being said regulated output voltage VOUT; wherein a source of said second p-channel FET transistor connected to said input voltage VIN; wherein a drain of said first p-channel FET transistor connected to a drain of said n-channel FET transistor; wherein a gate of said first p-channel FET transistor and a gate of said second p-channel FET transistor connected to said drain of said n-channel FET transistor; wherein said gate of said first p-channel FET transistor connected to said gate of said second p-channel FET transistor. AMP1 receives the reference signal at its positive terminal and receives the first feedback signal FB1, which is generated through R1 and R2 feedback network, at its negative terminal. The output signal of AMP1 is connected to the positive terminal of AMP2. The second feedback signal FB2 is connected to the negative terminal of AMP2. The voltage level of the first feedback signal is proportional to the regulator output voltage VOUT. The voltage level of the second feedback signal is proportional to VOUT. The output of AMP2 is connected to the gate of M1. R1 and R2 are connected in series between VOUT and the ground potential. R3 and R4 are connected in series between VOUT and the ground potential. The source of M2 and the source of M3 are connected to the input voltage VIN. The drain of M3 is the LDO output voltage VOUT. M1 and M2 are connected in series between VIN and the ground potential. The gate of M2 is connected to the gate of M3. The gate of M2 and the gate of M3 are connected to the drain of the M2 and the drain of the M3. The p-channel FET transistor may be configured to be a Bipolar Junction Transistor (BJT) or a Field Effect Transistor (FET), such as JFET or MOSFET. In other alternative embodiments of FIG. 4, the p-channel FET transistor M3 can be replaced by an n-channel FET transistor; wherein the M1 and M2 need to be re-configured accordingly and the connecting terminals of AMP1 and AMP2 need to be re-configured accordingly as well.

Figure 5:
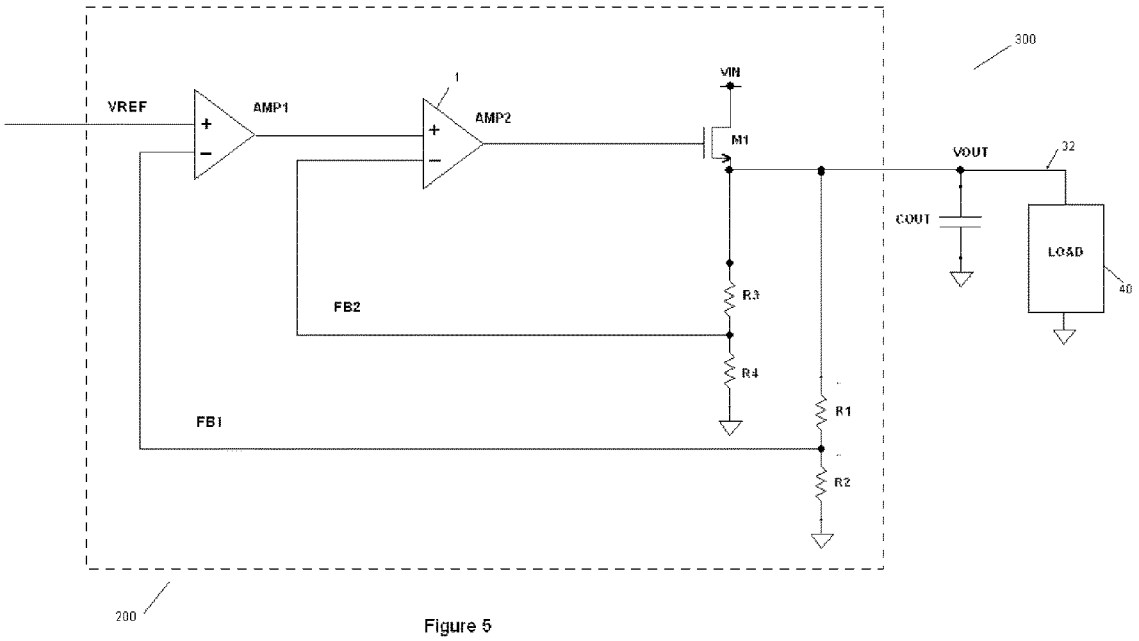
FIG. 5 is a schematic diagram of a low dropout voltage regulator (LDO) according to an alternative embodiment of the subject invention of FIG. 1.

FIG. 5 is a schematic diagram of a low dropout voltage regulator (LDO) 300 according to an alternative embodiment of the subject invention. Regulator 300 receives an input voltage VIN and generates a regulated output voltage VOUT. Referring to FIG. 5, a low dropout voltage regulator 300 includes an n-channel FET transistor M1, a first feedback network comprising a resistor R1 and a resistor R2 as a voltage divider, a second feedback network comprising a resistor R3 and a resistor R4, a first error amplifier AMP1, and a second error amplifier AMP2; wherein a drain of said n-channel FET transistor connected to said input voltage VIN; wherein a source of said n-channel FET transistor being said regulated output voltage VOUT. The voltage level of the first feedback signal is proportional to the regulator output voltage VOUT. The voltage level of the second feedback signal is proportional to the regulator output voltage VOUT. The AMP1 receives the reference signal at its positive terminal and receives the first feedback signal FB1, which is generated through R1 and R2 feedback network, at its negative terminal. The output signal of AMP1 is connected to the positive terminal of AMP2. The second feedback signal FB2 is connected to the negative terminal of AMP2. The output of AMP2 is connected to the gate of M1. R1 and R2 are connected in series between the VOUT and the ground potential. R3 and R4 are connected in series between the VOUT and the ground potential. The drain of M1 is connected to the input voltage VIN. The source of M1 is the LDO output voltage VOUT at node 32. The n-channel FET transistor may be configured to be a Bipolar Junction Transistor (BJT) or a Field Effect Transistor (FET), such as JFET or MOSFET.

Figure 6:
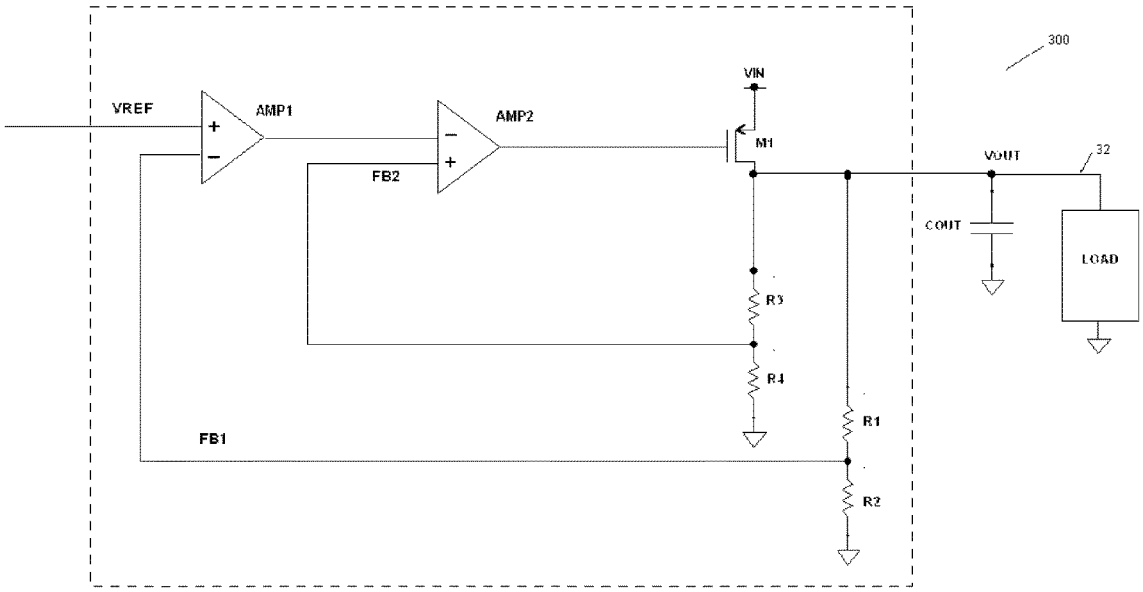
FIG. 6 is a schematic diagram of a low dropout voltage regulator (LDO) according to another alternative embodiment of the subject invention of FIG. 5.

FIG. 6 is a schematic diagram of a low dropout voltage regulator (LDO) 300 according to another embodiment of the subject invention. Regulator 300 receives an input voltage VIN and generates a regulated output voltage VOUT. Referring to FIG. 6, a low dropout voltage regulator 300 includes a p-channel FET transistor M1, a first feedback network comprising a resistor R1 and a resistor R2 as a voltage divider, a second feedback network comprising a resistor R3 and a resistor R4, a first error amplifier AMP1, and a second error amplifier AMP2; wherein a source of said p-channel FET transistor connected to said input voltage VIN; wherein a drain of said p-channel FET transistor being said regulated output voltage VOUT. The AMP1 receives the reference signal at its positive terminal and receives the first feedback signal FB1, which is generated through R1 and R2 feedback network, at its negative terminal. The voltage level of the first feedback signal is proportional to the regulator output voltage VOUT. The voltage level of the second feedback signal is proportional to the regulator output voltage VOUT. The output signal of AMP1 is connected to the negative terminal of AMP2. The second feedback signal FB2 is connected to the positive terminal of AMP2. The output of AMP2 is connected to the gate of M1. R1 and R2 are connected in series between the VOUT and the ground potential. R3 and R4 are connected in series between the VOUT and the ground potential. The drain of M1 is connected to the input voltage VIN. The source of M1 is the LDO output voltage VOUT at node 32. The p-channel FET transistor may be configured to be a Bipolar Junction Transistor (BJT) or a Field Effect Transistor (FET), such as JFET or MOSFET.

Figure 7:
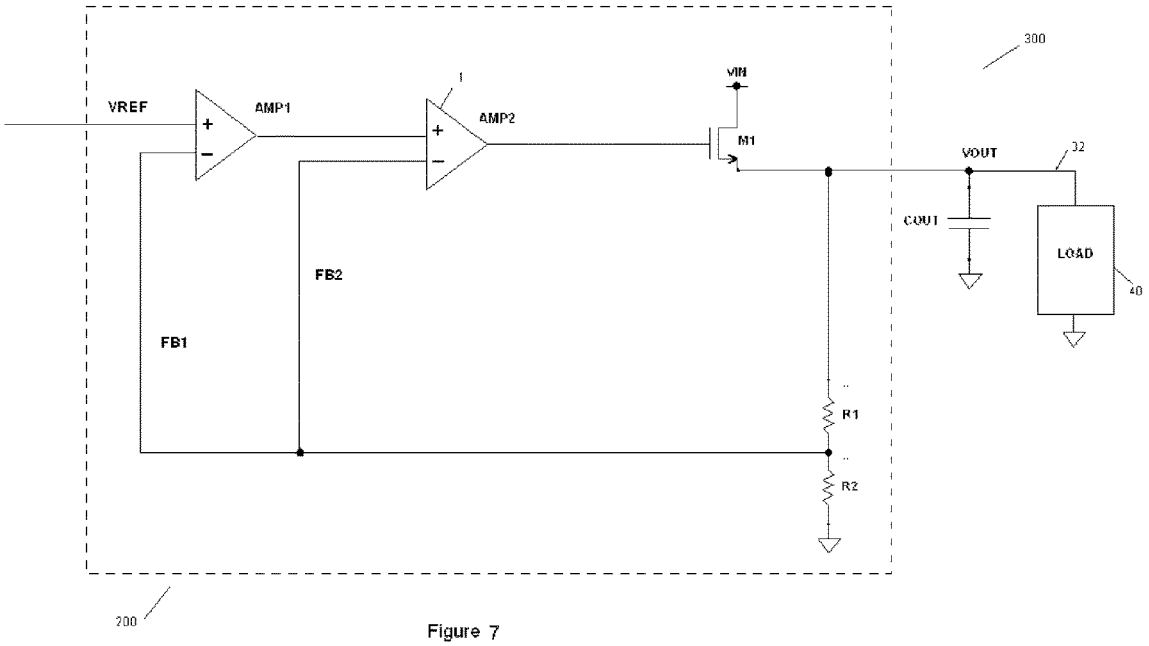
FIG. 7 is a schematic diagram of a low dropout voltage regulator (LDO) according to another alternative embodiment of the subject invention wherein the resistor R3 and R4 are optional and may be omitted.

Referring to FIG. 7, in some extreme cases, when the first feedback signal FB and the second feedback FB signal can be generated from resistor R1 and resistor R2, resistor R3 and R4 are optional and may be omitted.

Figure 8:
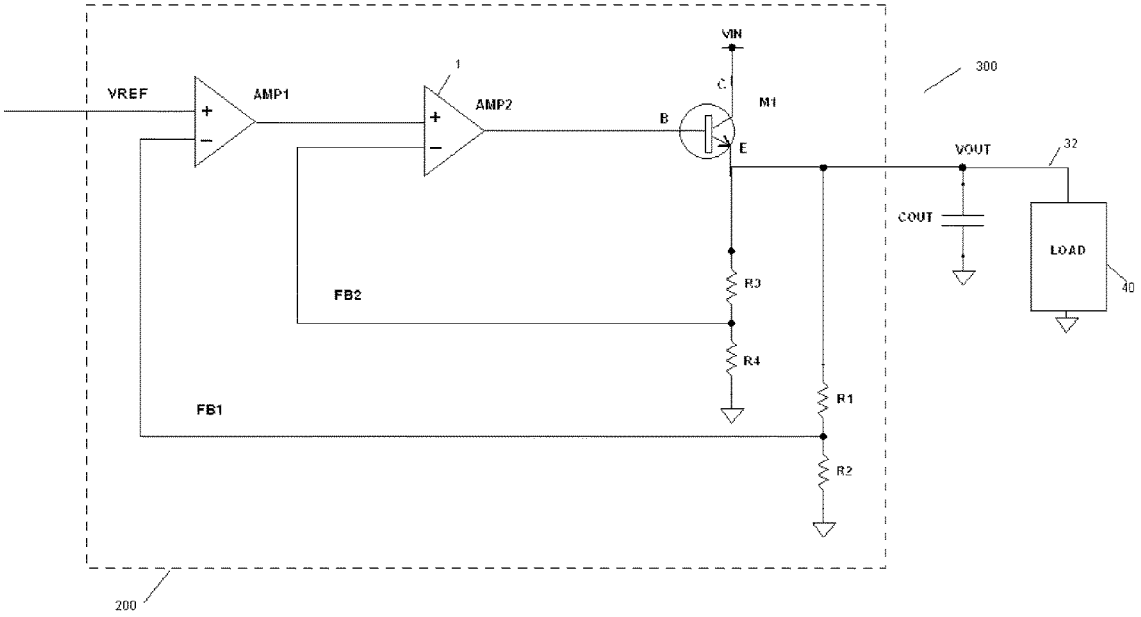
FIG. 8 is a schematic diagram of a low dropout voltage regulator (LDO) according to another alternative embodiment of the subject invention wherein the FET transistor in FIG. 5 is replaced by a Bipolar Junction Transistor (BJT) transistor.

Referring to FIG. 8, the FET transistor in FIG. 5 may be configured to be a Bipolar Junction Transistor (BJT) transistor. In FIG. 8, the output of AMP2 is connected to the base terminal B of M1. The collector terminal C of M1 is connected to the input voltage VIN. The emitter terminal E of M1 is the LDO output voltage VOUT at node 32.

The described embodiments in this subject invention can be used in other types of low dropout regulators. The invention is capable of other and different embodiments and its several details are capable of modification in various other respects, all without departing from the spirit and scope of the subject invention. Accordingly, the disclosed embodiments, drawings, and detailed description are to be merely regarded as illustrative in nature and not restrictive.

What is claimed is:

1. A low dropout regulator configured to receive an input voltage VIN and to generate a regulated output voltage VOUT; and said low dropout regulator comprising:

a reference signal;

a first feedback signal and a second feedback signal;

a first resistor and a second resistor connected in series;

a third resistor and a fourth resistor connected in series;

wherein said first feedback signal connected between said first resistor and said second resistor; wherein said second feedback signal connected between said third resistor and said fourth resistor;

a first transistor;

a first amplifier configured to receive said reference signal and said first feedback signal and to generate an output signal of said first amplifier;

a second amplifier configured to receive said second feedback signal and said first amplifier output signal and to generate an output signal of said second amplifier; wherein said second amplifier output signal coupled to a first terminal of said first transistor.

2. Said low dropout regulator of claim 1, wherein said first terminal of said first transistor configured to be a gate of said first transistor; wherein said first transistor configured to be an n-channel FET transistor;

wherein said reference signal coupled to a positive terminal of said first amplifier; wherein said first feedback signal coupled to a negative terminal of said first amplifier;

wherein said first amplifier output signal coupled to a positive terminal of said second amplifier; wherein said second feedback signal coupled to a negative terminal of said second amplifier;

wherein said first feedback signal being proportional to said regulated output voltage VOUT; wherein said second feedback signal being proportional to said regulated output voltage VOUT.

3. Said low dropout regulator of claim 2, further comprising said first resistor and said second resistor connected in series between said source of said n-channel FET transistor and a first ground potential;

a third resistor and a fourth resistor connected in series between said source of said n-channel FET transistor and a second ground potential.

4. Said low dropout regulator of claim 1, wherein said first terminal of said first transistor configured to be a gate of said first transistor; wherein said first transistor configured to be a p-channel FET transistor;

wherein said reference signal coupled to a positive terminal of said first amplifier; wherein said first feedback signal coupled to a negative terminal of said first amplifier;

wherein said first amplifier output signal coupled to a negative terminal of said second amplifier; wherein said second feedback signal coupled to a positive terminal of said second amplifier;

wherein said first feedback signal being proportional to said regulated output voltage VOUT; wherein said second feedback signal being proportional to said regulated output voltage VOUT.

5. Said low dropout regulator of claim 4, further comprising said first resistor and said second resistor connected in series between said drain of said p-channel FET transistor and a first ground potential;

said third resistor and said fourth resistor connected in series between said drain of said p-channel FET transistor and a second ground potential.

6. Said low dropout regulator of claim 1, further comprising:

a second transistor and a third transistor;

wherein said first terminal of said first transistor configured to be a gate of said first transistor; wherein said first transistor configured to be an n-channel FET transistor; wherein said second transistor configured to be a first p-channel FET transistor; wherein said third transistor configured to be a second p-channel FET transistor;

wherein a source of said n-channel FET transistor connected to a first ground potential;

wherein said first feedback signal being proportional to said regulated output voltage VOUT; wherein said second feedback signal being proportional to said regulated output voltage VOUT;

wherein said n-channel FET transistor or said first p-channel FET transistor or said second p-channel FET transistor may configured to be a Field Effect Transistor (FET) or a Bipolar Junction Transistor (BJT) transistor.

7. Said low dropout regulator of claim 6, further comprising:

a first resistor and a second resistor connected in series between a drain of said second p-channel FET transistor and a second ground potential;

a third resistor and a fourth resistor connected in series between said drain of said second p-channel FET transistor and a third ground potential.

8. Said low dropout regulator of claim 1, wherein in case when said second feedback signal being generated from said first resistor and said second resistor, said third resistor and said fourth resistor being optional and may be omitted.

9. Said low dropout regulator of claim 1, wherein said first transistor may configured to be a Field Effect Transistor (FET) or a Bipolar Junction Transistor (BJT).

10. A method for operating a voltage regulator receiving an input voltage VIN and generating a regulated regulator output voltage VOUT on an output node of said voltage regulator; said method comprising:

generating a reference signal;

generating a first feedback signal through a first resistor and a second resistor connected in series between said VOUT and a first ground potential;

generating a second feedback signal through a third resistor and a fourth resistor connected in series between said VOUT and a second ground potential;

controlling a transistor;

receiving said reference signal and said first feedback signal through a first amplifier and generating a first amplifier output signal;

receiving said first amplifier output signal and said second feedback signal through a second amplifier and generating a second amplifier output signal; wherein said second amplifier output signal coupled to a first terminal of said first transistor.

11. Said method of claim 10, wherein said first terminal of said first transistor configured to be a gate of said first transistor; wherein said first transistor configured to be an n-channel FET transistor;

wherein said reference signal coupled to a positive terminal of said first amplifier; wherein said first feedback signal coupled to a negative terminal of said first amplifier;

wherein said first amplifier output signal coupled to a positive terminal of said second amplifier; wherein said second feedback signal coupled to a negative terminal of said second amplifier;

wherein said first feedback signal being proportional to said regulated output voltage VOUT; wherein said second feedback signal being proportional to said regulated output voltage VOUT;

wherein said first transistor may configured to be a Field Effect Transistor (FET) or a Bipolar Junction Transistor (BJT).

12. Said method of claim 10, wherein said first terminal of said first transistor configured to be a gate of said first transistor; wherein said first transistor configured to be a p-channel FET transistor; wherein a source of said p-channel FET transistor connected to said VIN; wherein a drain of said p-channel FET transistor being said VOUT;

wherein said reference signal coupled to a positive terminal of said first amplifier; wherein said first feedback signal coupled to a negative terminal of said first amplifier;

wherein said first amplifier output signal coupled to a negative terminal of said second amplifier; wherein said second feedback signal coupled to a positive terminal of said second amplifier;

wherein said first feedback signal being proportional to said regulated output voltage VOUT; wherein said second feedback signal being proportional to said regulated output voltage VOUT;

wherein said first transistor may configured to be a Field Effect Transistor (FET) or a Bipolar Junction Transistor (BJT).

13. Said method of claim 10, further comprising:

controlling a first p-channel FET transistor and a second p-channel FET transistor;

wherein said first terminal of said first transistor configured to be a gate of said first transistor;

wherein said first transistor configured to be an n-channel FET transistor;

wherein a source of said n-channel FET transistor connected to a third ground potential;

wherein said first feedback signal being proportional to said regulated output voltage VOUT; wherein said second feedback signal being proportional to said regulated output voltage VOUT;

wherein said first p-channel FET transistor or said second p-channel FET transistor or said n-channel FET transistor may configured to be a Field Effect Transistor (FET) or a Bipolar Junction Transistor (BJT).

14. Said method of claim 10, wherein in case when said first feedback signal and said second feedback signal being generated from said first resistor and said second resistor, said third resistor and said fourth resistor being optional and may be omitted.

* * * * *